United States Patent [19]

Baker

[11] Patent Number: 4,488,249

[45] Date of Patent: Dec. 11, 1984

[54] ALIGNMENT ERROR CALIBRATOR AND COMPENSATOR

[75] Inventor: Edward B. Baker, Tulsa, Okla.

[73] Assignee: Martin Marietta Corporation, Bethesda, Md.

[21] Appl. No.: 345,892

[22] Filed: Feb. 4, 1982

[51] Int. Cl.[3] ..... G01C 25/00; G01C 21/18

[52] U.S. Cl. ..... 364/571; 364/516; 73/1 E; 358/125

[58] Field of Search ..... 364/571, 516, 453, 454, 364/559; 73/1 E; 358/125

[56] References Cited

U.S. PATENT DOCUMENTS

| | | | |
|---|---|---|---|
| 3,430,238 | 2/1969 | Buell et al. | 364/516 |
| 3,442,140 | 5/1969 | Pelteson | 364/571 |
| 3,518,372 | 6/1970 | Johns | 358/125 |
| 3,576,124 | 4/1971 | O'Connor | 364/454 |
| 3,633,003 | 1/1972 | Talwani | 364/559 |
| 3,731,521 | 5/1973 | Solov et al. | 73/1 E |
| 3,782,167 | 1/1974 | Stuelpnagel | 72/1 E |
| 3,829,659 | 8/1974 | Margolis | 364/516 |

OTHER PUBLICATIONS

Gibb and Lane, "A Line of Sight Stabilisation System", Mar. 1981, vol. 1, No. 1, Journal of Electrical and Electronics Engineering, Australia.

*Primary Examiner*—Jerry Smith
*Assistant Examiner*—Karl Huang
*Attorney, Agent, or Firm*—Julian C. Renfro; William J. Iseman; Gay Chin

[57] ABSTRACT

In an airborne target acquisition and tracking system having a stabilization axis and an optical axis in which a slight mechanical misalignment is present, an apparatus and method for electronically compensating for such misalignment. A roll rate sensing circuit in the system produces a signal when the aircraft rolls. A yaw scaling factor circuit and a pitch scaling factor circuit operate on the roll rate signal and apply scaled versions thereof to the yaw rate servo subsystem and the pitch rate servo subsystem respectively to cancel a yaw rate error signal and a pitch rate error signal produced by the mechanical misalignment. The required scale factors are automatically adjusted by use of a calibrate mode by microprocessors that calculate the ratio of yaw and pitch error signals, generated by artifically rolling the system, to the roll rate signal also generated. The measured ratios are stored in non-volatile memories functioning when the system is in the operate mode. Alternatively, the system control computer may be programmed to provide the above noted calibration and compensation functions.

12 Claims, 9 Drawing Figures

ALIGNMENT ERROR CALIBRATOR AND COMPENSATOR

BACKGROUND OF THE INVENTION

1. Field of the Invention

The present invention relates to apparatus and methods for electronically correcting the line of sight alignment of an optical system stabilized by a two axis or three-axis gyroscope system, and more particularly, apparatus and methods for calculating and storing data representative of pitch and yaw error signals at time of installation of the gyroscope system in a vehicle and thereafter utilizing such stored data to compensate the pitch and yaw control systems.

2. Description of the Prior Art

A number of military weapons systems include a stable platform for mounting optical devices for sighting of targets. The platform is controlled by a set of roll, pitch and yaw gyros via servomechanisms. A typical system is the Target Acquisition and Designation System (TADS) in which a lens system is focused on a vidicon television camera which drives a television (TV) display. When the system is attached to a fixed or rotary wing aircraft, the pilot can observe the terrain, within the field of view of the optics, on the TV display. The pilot may manually bring a desired target into the center of the display screen and then switch the system to a tracking mode. Thereafter, the stable platform will remain fixed in space with the optics aimed at the target while the aircraft maneuvers.

Each of the three gyros in the stabilization system has a sensitive axis which its associated servo will maintain in a fixed direction in inertial space when the system is in the stabilized mode. The pitch and yaw axes define a plane with an axis perpendicular thereto defined as the stabilization axis. As may now be recognized, the stabilization axis will remain fixed in space as the aircraft moves. If the optical axis of the camera lens system is not exactly aligned with the stabilization axis, the image or picture on the TV screen will not remain centered but will appear to move in an arc as the aircraft experiences roll, pitch and yaw movements. Thus, when a TADS unit is installed, it is necessary to mechanically adjust the platform and television optical system to ensure that the line of sight (LOS) is aligned with the stabilization axis within less than 1 milliradian (mr). Such mechanical adjustment is difficult and time consuming, even for skilled technicians. After a system is in service, it is possible for misalignment to occur from accident or upon replacement of failed mechanical components. Such circumstances may require the aircraft to be returned to a repair facility having the test equipment and trained personnel to readjust the system. Thus, a need has existed for automating the LOS alignment procedure to reduce the labor and time required for manual adjustment, to obtain increased accuracy, and to permit field alignment.

SUMMARY OF THE INVENTION

The present invention is used with a two axis stable platform system in which small rate integrating gyros are provided for the roll, pitch and yaw axes. Position error signals from the gyros are utilized in conventional closed loops to drive servo motors or torquers that move the platform. External pitch and yaw rate commands from a system computer are applied to respective pitch and yaw gyro torquers to permit automatic tracking of targets or manual control of the system. In the TADS unit which will be used to explain a typical application of the invention, a television vidicon camera with its associated optical system is mounted to the platform.

If the camera optical system LOS were perfectly aligned with the stabilization axis of the gimbal system, a roll of the aircraft would not cause any motion of the reticle on the TV screen. If a target were on boresight and centered in a reticle on the TV screen, an observer would note only a tilting of the horizon with the target remaining centered on boresight. However, if the gyro system is not aligned with the LOS of the optical system, it may be understood that a roll of the aircraft will cause small false pitch and yaw motion of the TV reticle to be generated. The result is that the scene on the TV screen will indicate not only a roll but also slight pitch and yaw. If the aircraft performed a 360° roll, the target would move off from the center and move in a small circle displaced from boresight.

In accordance with the invention, assume that a TADS unit is installed in an aircraft and that a small error exists between the optical and stabilization axis. The optical system is centered on an appropriate artificial target and the system set to a calibrate mode and in automatic tracking. The present invention includes, in the calibrate mode, means for producing a slowly varying signal, for example, at 2 Hz, which is applied to the azimuth servo causing the roll gyro to produce a roll rate signal. The target is observed on the TV screen and will be seen to move in a circular arc about the roll or stabilization axis with a radius equal to the root sum square of the pitch and yaw alignment errors due to the mechanical misalignment. It is next necessary to measure the magnitude of the yaw misalignment error $\epsilon_y$ and the pitch misalignment error $\epsilon_p$. The invention contemplates adding a small percentage of the roll rate signal to the pitch servo system and to the yaw servo system in a magnitude and polarity to cancel the false pitch and yaw motion caused by the misalignment.

Since the magnitude of the varying azimuth signal is known, the values of the gyro misalignment error signals $\epsilon_y$ and $\epsilon_p$ can be determined and compared to the roll signal to produce a proportionality or scaling factor for each. This factor is stored in the control system and the system switched to the operate mode. This connects the roll rate output to the external pitch rate command input of the pitch servo via a scaler having the stored $\epsilon_y$ scale factor, and to the external yaw rate command input of the yaw servo via a scaler having the stored $\epsilon_p$ scale factor.

As may now be recognized, when the pitch servo or the yaw servo receive external commands from the system computer and the gimbals react in response thereto, the signal is modified by a scaled portion of a roll rate signal, generated electronically which has an amplitude and phase to exactly cancel the effects of the misalignment. Therefore, the scene displayed on the TV screen will remain on boresight regardless of the maneuvers of the aircraft.

DETAILED DESCRIPTION OF THE PREFERRED EMBODIMENT

Figure 1:
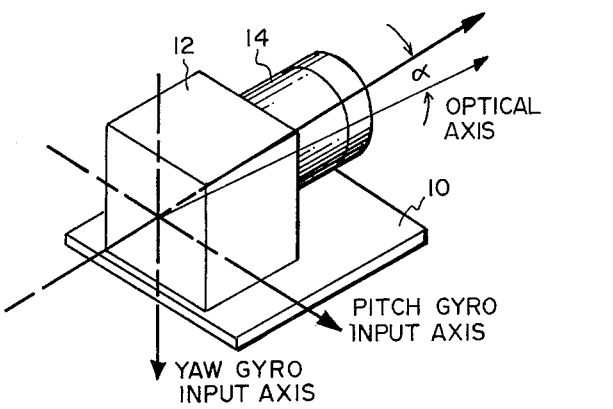
FIG. 1 is a schematic representation of an aircraft stabilized platform showing the stabilization axis thereof and having an optical system mounted thereon whose optical axis is misaligned with the stabilization axis.

Referring to FIG. 1, a schematic representation is given of a stabilized platform 10 having an optical system 12 with lens 14 mounted thereon. Platform 10 is assumed to be mounted in an aircraft and stabilized by a gyroscope aligned with each axis. As may be noted, the pitch gyro input axis and the yaw gyro input axis define a plane having an axis perpendicular thereto defined as a stabilization axis. The optical system and lens 12, 14 will have an axis defined as the optical axis. Due to inherent mechanical tolerances in the construction of the stabilized platform 10 as well as the optical system 12, 14, it is found that, after installation in a typical aircraft, the optical axis and the stabilization axis will not be exactly aligned, as indicated in a somewhat exaggerated manner by angle $\alpha$.

Figure 2:
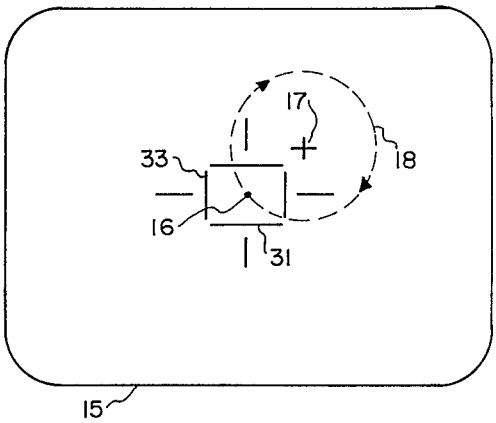
FIG. 2 is a diagram of a typical target acquisition and designation system display showing the apparent movement of a target on boresight in response to movement of the aircraft when there is misalignment between the optical axis of the system and the stabilization axis of the stabilized platform.

The system known as the Target Acquisition Designation System (TADS) has the above noted problem and will serve as an example for explaining the invention. FIG. 2 illustrates a typical TADS display seen by the pilot of the aircraft. In the TADS, a scene within the field of view of lens system 14 will be shown via a television system on screen 15 which is typically a cathode ray tube display. The pilot will control his aircraft to place a target or other center of interest at the center point 16 of screen 15 representing the line of sight of the optical axis of the system. However, maneuvering of the aircraft, for example, a 360° roll, will cause the target center point 16 to move on screen 15 as indicated by path 18. Assuming that the cross 17 in FIG. 2 indicates the point of the stabilization axis, this point will stay fixed in space as the aircraft moves. When the aircraft rolls, pitches and yaws, the scene or picture will not be stabilized but will appear to move about the stabilization axis.

The amount of the motion of the image due to the gyroscope misalignments can be calculated in terms of the degree of misalignment. Letting $E_p$ equal the pitch gyro misalignment and $E_y$ equal the yaw gyro misalignment, the radius of the circle 18 as the TADS system rolls is given by the equation $$r=\sqrt{E_y^2+E_p^2}$$

where $r$ = radius in milliradians (mr), $E_y$ = yaw error in mr, and $E_p$ = pitch error in mr.

Figure 3:
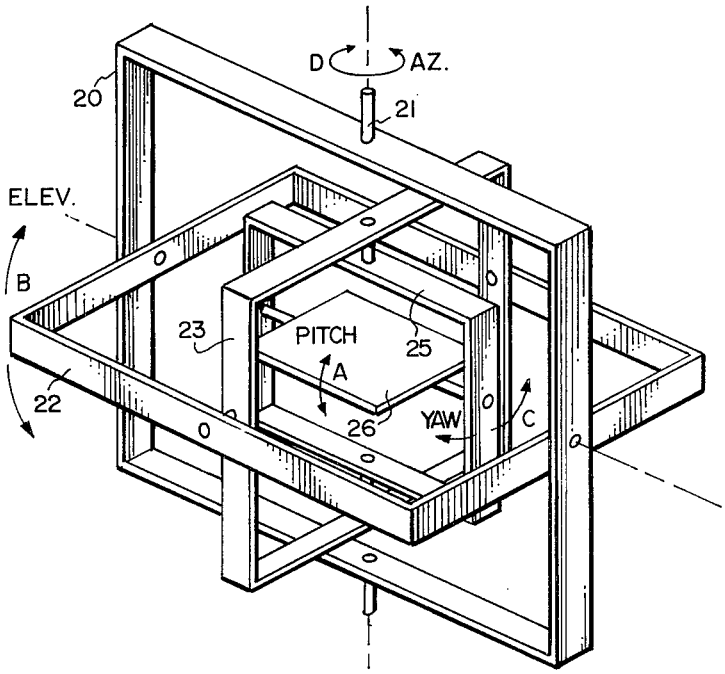
FIG. 3 shows a simplified schematic diagram of a gimbal system typically used in a stabilized platform.

As discussed hereinabove, correcting the mechanical misalignment of the gyros is a time consuming and difficult task. Advantageously, the present invention eliminates the need for exact mechanical alignment by providing corrective signals to the stabilized platform servo system. Turning now to FIG. 3, a simplified schematic diagram of a typical gimbal system is shown. Although the TADS does not utilize the intermediate gimbal 23, this construction is used in similar systems. The stabilized platform is represented at 26 pivoted in inner gimbal 25. Platform 26 may move as shown by arrow A referred to as a movement in pitch. However, the movement within gimbal 25 of platform 26 may be limited in many cases to ±2° and therefore would be ineffective for greater movements of the aircraft. Therefore, an outer gimbal 22 is provided having its axis coincident with the axis of platform 26. In the TADS, for example, outer gimbal 22 has a freedom of movement of +30° and −60°, representing maximum limits within which the associated aircraft is expected to maneuver when utilizing the TADS. Movement of the outer gimbal 22 as shown by arrows B is referred to as movement in elevation.

Inner gimbal 25 may be pivoted to intermediate gimbal 23 along a vertical axis referred to as the yaw axis. The freedom of gimbal 25 to move in yaw as indicated by arrows C is also ±2° for the TADS. Accordingly, an outer gimbal 20 is provided having pivots 21 with a vertical axis coincident with the axis of inner gimbal 25. Outer 20 gimbal has 360° of rotation as indicated by arrow D with this axis referred to as the azimuth axis. As is coventional with TADS-type stabilized platforms, the outer gimbals 22 and 20 are driven by servo motors which derive their error signal from position sensors mounted between the inner and outer gimbals while inner gimbals 25 and 23 are controlled by servo motors which derive their error signals from the gyroscopes attached to platform 26. Thus, movements of the aircraft may be isolated from the innermost gimbal.

Figure 4:
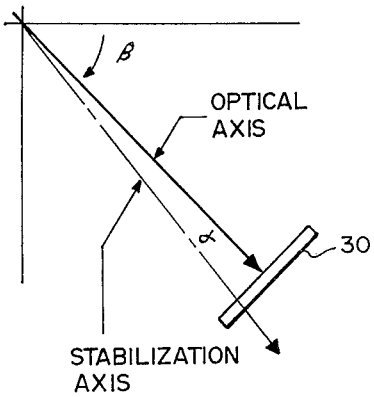
FIG. 4 represents a method of orienting the optical axis of a target acquisition and designation system with respect to a target during calibration of the system.

As will be discussed in more detail later, it is necessary to produce movement of the TADS system during calibration of the invention. In one approach, it is desired to aim the optical axis downward in elevation at an angle $\beta$ as shown in the diagram of FIG. 4. Here the optical axis is aimed at the center of a fixed target 30 with an exaggerated error of $\alpha$ degrees between the optical axis and the stabilization axis indicated. To accomplish this, a command is given to the pitch rate servo of the system which would tend to cause platform 26 of FIG. 3 to pitch downward. A value of $\beta$ in the range of 30° to 45° is commonly required and therefore the system will respond by driving outer gimbal 22 downward $\beta$ degrees in elevation. Platform 26 will, of course, follow and the optical axis will therefore assume the angle $\beta$ as desired.

Figure 5:
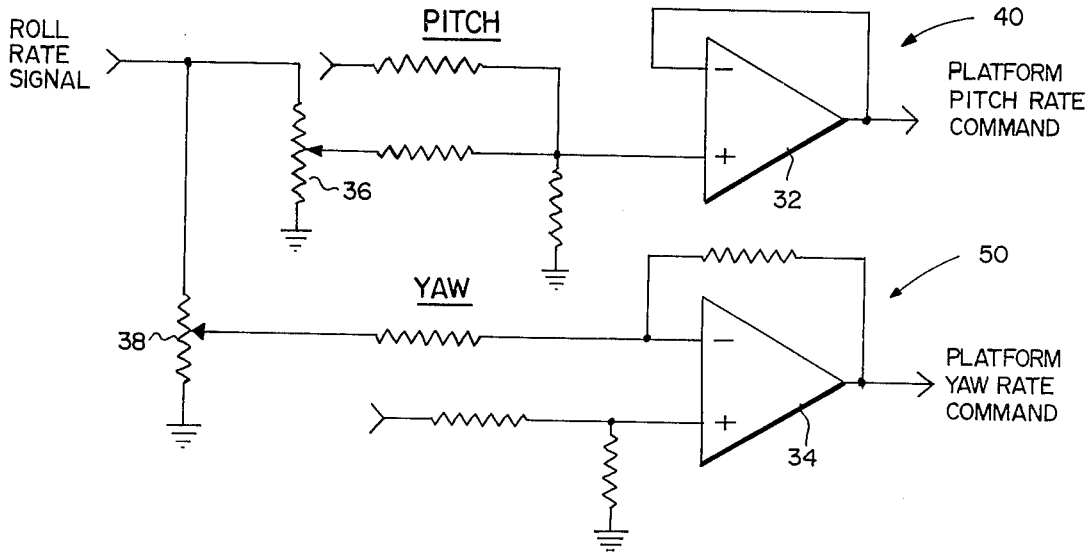
FIG. 5 is a simplified schematic diagram of pitch and yaw calibration circuits to correct for an optical axis error in accordance with the invention.
Figure 6:
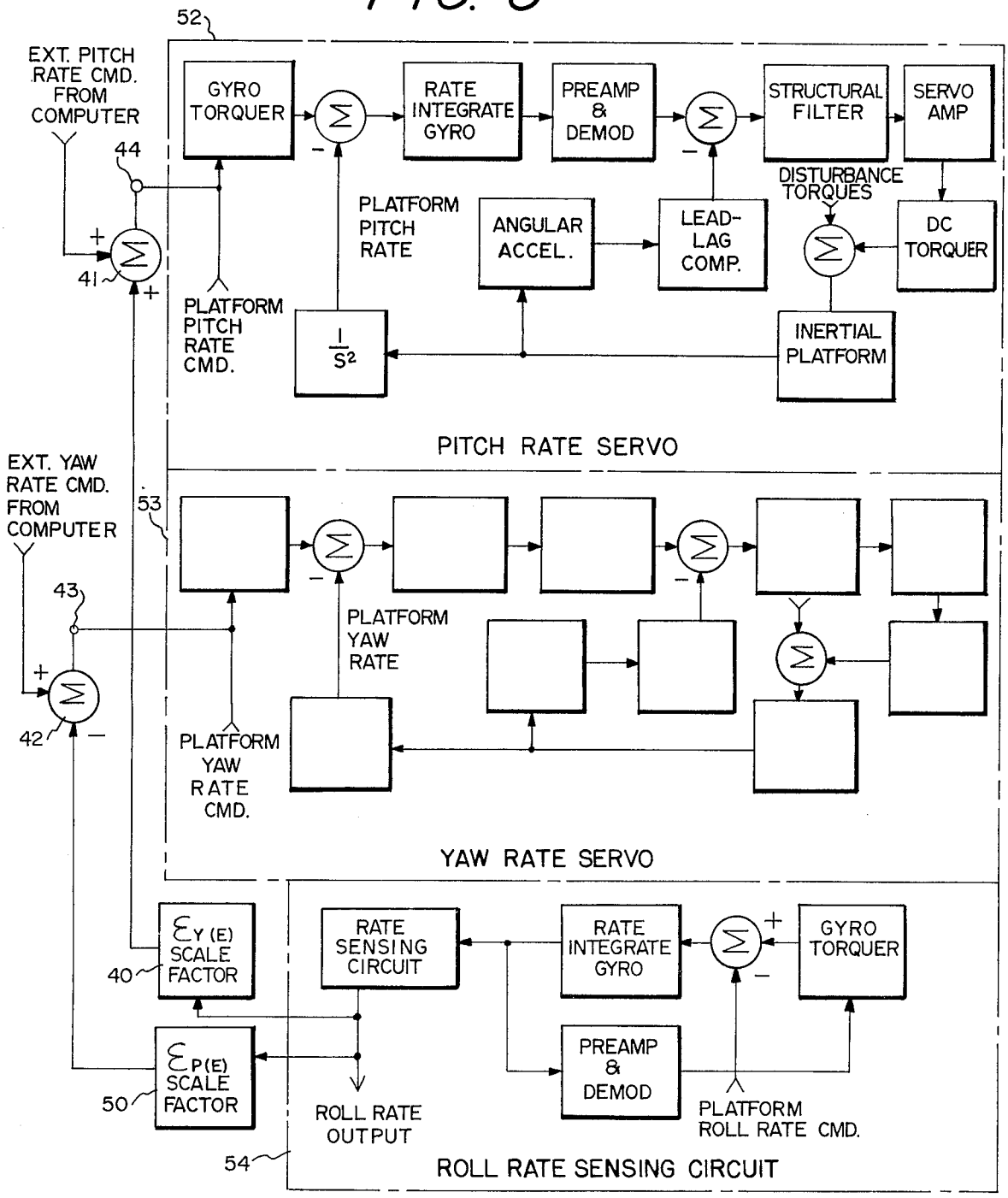
FIG. 6 is a functional block diagram of a typical stabilization servc system having pitch rate, yaw rate, and roll rate gyros and which incorporates the electronic compensation system of the invention.

One implementation of the invention may be seen with reference to FIGS. 5 and 6. In FIG. 6, a typical prior art rate servo system for a stabilized platform is indicated by pitch rate servo 52, yaw rate servo 53, and roll rate sensing circuit 54. To command the platform to assume desired elevation and azimuth headings, it is conventional to utilize a computer and to provide the pilot with controls for entering desired commands into the computer. For example, a pitch rate command from the computer would, in a prior art system, be communicated to the pitch rate servo via terminal 44 in FIG. 6. Similarly, a yaw rate command signal would appear at terminal 43 of yaw rate servo 53. However, in accordance with the invention, the commands are entered via summers 41 and 42. Although not shown in detail, the roll rate sensing circuit 54 provides appropriate signals to pitch and yaw rate servos 52 and 53 to achieve the required degree of stabilization of the platform.

When the stabilization axis and the optical axis are not exactly aligned, it will be recalled that commands given to pitch rate servo 52 and yaw rate servo 53 will result in error signals due to misalignment such as to produce movement of the scene on the pilot's display as discussed with respect to FIG. 2. Advantageously, the invention produces electrical error signals from the roll rate sensing circuit 54 output which are then added to command signals with an amplitude and phase which will exactly cancel the misalignment error and prevent movement of the scene on the pilot's display. As indicated in FIG. 6, $\epsilon_y$ scale factor circuit 40 is connected to receive the roll rate output signal and to produce an output signal to summer 41 of pitch rate servo 52. Assuming that the pitch rate servo is receiving external pitch rate command from the computer, the error signal $\epsilon_{y(E)}$ will be added to the incoming command signal. This will cause the movement of the platform in pitch to include a movement which will exactly compensate for the erroneous movement due to mechanical misalignment of the yaw rate gyro. Similarly, $\epsilon_p$ scale factor circuit 50 provides error signal $\epsilon_{p(E)}$ to summer 42 which will be added to a yaw rate command and will correct the movement in yaw due to the mechanical misalignment of the pitch rate servo. As may now be recognized, it is necessary to calibrate scale factor circuits 40 and 50 in accordance with the degree of mechanical misalignment of the stabilization axis. FIG. 5 is a simplified schematic diagram of typical circuits for scale factor circuits 40 and 50. The roll rate output signal is connected to potentiometers 36 and 38 in parallel. The pitch rate error output signal is controlled by potentiometer 36 via amplifier 32. During calibration procedures, potentiometer 36 is manually adjusted to produce the required pitch error signal to compensate for that mechanical misalignment. Similarly, potentiometer 38 controls the yaw error signal via amplifier 34 and is calibrated to compensate for the yaw mechanical error.

Although not entirely practical, a simplified calibration procedure will now be described to show the principles involved. Assume that the aircraft is on the ground and an artificial target pattern is placed with its center on the optical axis of the optical system as indicated by the center appearing at the center of the display of FIG. 2. The TADS system is then mechanically set in motion to produce a roll of the optical line of sight such as to produce movement of the target center in a circle as shown in FIG. 2. Circuits 40 and 50 are connected to summers 41 and 42, respectively, which will introduce signals from the roll rate output into the gyro torquers of the pitch rate servo and the yaw rate servo which will be in addition to the signals coming from the platform pitch rate command and the platform yaw rate command. Thus, the circle observed on display 15 of FIG. 2 will change. At this point, potentiometers 36 and 38 are manually adjusted until the movement of the target center ceases and returns to the center of the screen 16. At this point, as may now be understood, the signal produced by the roll rate sensing circuit 54 has been attenuated and applied to the pitch and yaw rate servos 52 and 53 to exactly compensate for the error signals generated from the mechanical misalignment of the stabilization axis and the optical axis.

One refinement of this method is made possible due to the tracking capabilities of the TADS system. As is well known, the tracking computer produces reticle lines 31 and 33 on display 15 as shown in FIG. 2. Whenever the center of the target moves with respect to the optical system, tracking signals send commands to the pitch rate servo 52 and yaw rate servo 53 such as to move the TADS platform with respect to the airframe so as to keep the target exactly centered as indicated by point 16 in FIG. 2. When the target is exactly centered, the elevation and azimuth tracking signals are zero. These signals therefore provide a convenient and precise means of manually adjusting scale factor circuits 40 and 50. Rather then attempting visually to determine when the target motion has ceased, pots 36 and 38 may be adjusted to obtain essentially zero tracking voltages.

Due to the relatively large size and mass of the TADS stabilized platform outer gimbals as well as the optical system, it is difficult to produce the desired TADS motions to perform the calibration procedure just described. Therefore, a preferred method of calibration will be described with reference to FIGS. 7 and 8.

Figure 7:
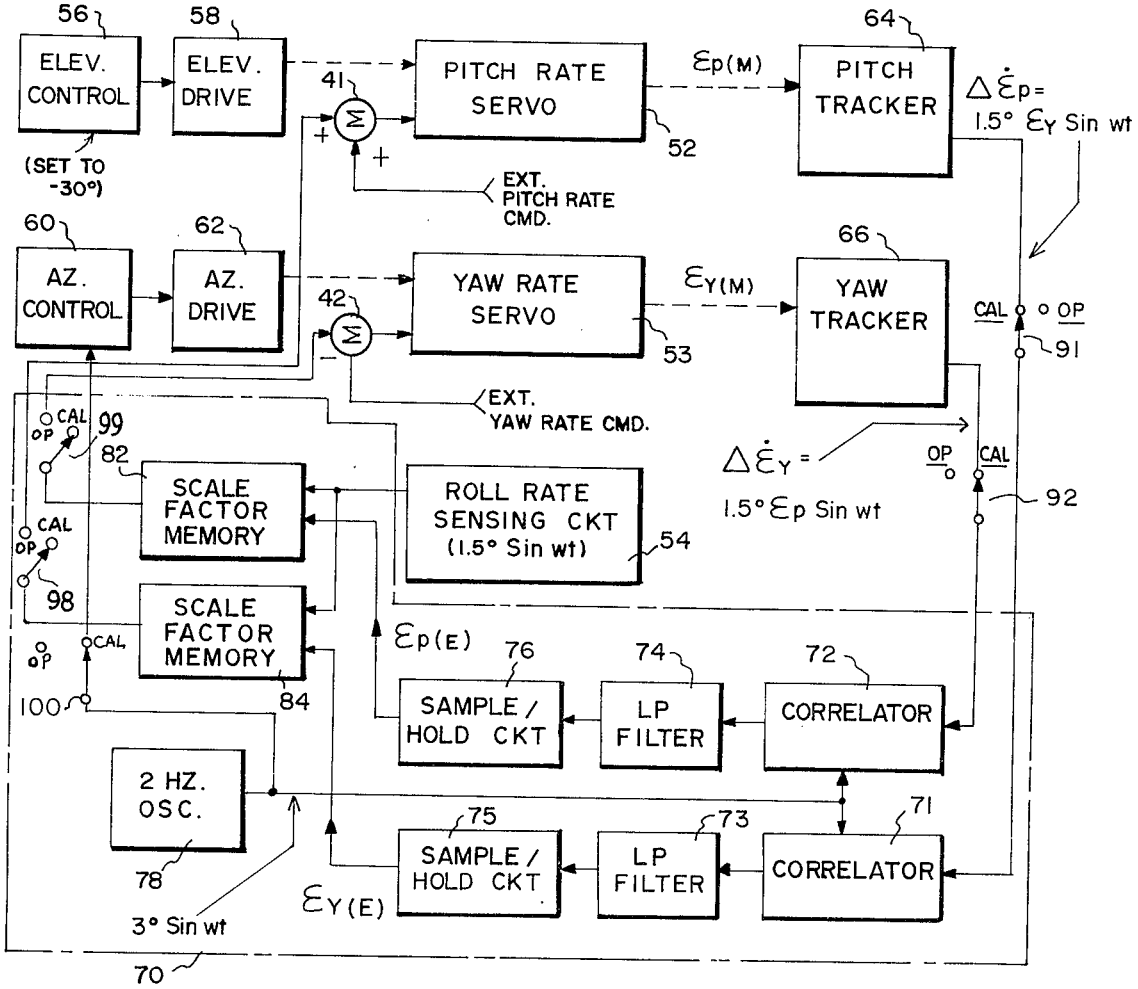
FIG. 7 is a functional block diagram of a portion of the invention which automatically calibrates and compensates the system of FIG. 6 for alignment errors.

FIG. 7 shows a functional block diagram of the TADS system connected to an automatic calibration and compensation system of the invention indicated by block 70. To calibrate a TADS system in accordance with this embodiment of the invention, the aircraft is parked and the elevation control 56 for the TADS is set to $-30°$. A fixed target pattern is disposed along the $-30°$ optical axis in the manner shown in FIG. 4. Setting elevation control 56 causes elevation drive 58 to drive the outside elevation gimbal to the set angle resulting in the center of the target appearing at the center of the display 15. The automatic calibration system 70 includes a 2 Hz oscillator 78, a pitch error measuring circuit comprising correlator 72, low pass filter 74, and sample/hold circuit 76, and a similar circuit for the yaw channel comprising correlator 71, low pass filter 73 and sample/hold circuit 75. The outputs of these two circuits are connected to scale factor memory 82 and scale factor memory 84. Switches 91, 92, 98 and 99 are set to the CALIBRATE positions, connecting the pitch and yaw tracker outputs to the calibration system 70, and disconnecting the roll rate signal from the servos 52,53.

With the TADS elevation set at $-30°$ it will be understood that the stabilized platform will be at this angle with reference to the horizontal and will be stabilized in this position. The 2 Hz oscillator 78 is connected to the TADS azimuth control circuit 60 by setting switch 100 to its calibrate position which will cause the azimuth drive to sinusoidally rotate the outer or azimuth gimbal of the platform at a 2 Hz rate. Preferably, the amplitude of oscillator 78 is set to produce a $\pm 3°$ excursion of the platform in azimuth. As indicated in FIG. 7, the motion of the platform is expressed by $3° \sin \omega t$ where $\omega$ is equal to $4\pi$. Due to the kinematics of a four gimbal system, the inner gimbal will experience a roll rate determined by the elevation angle and the rate of motion of the outer gimbal. Since the elevation angle has been selected at −30°, and the roll rate is proportional to the sine of that angle, the roll rate will be 1.5° sinωt as indicated for roll rate sensing circuit 54. Due to the mechanical misalignment with respect to the pitch rate gyro, the pitch and yaw trackers 64 and 66 will be attempting to track the apparent moving target and will therefore produce error position signals which are dependent upon mechanical pitch and yaw errors, $\epsilon_{y(m)}$ and $\epsilon_{p(m)}$. As derived in the appendix hereto the tracker output position signals will be expressed as 1.5° $\epsilon_y$ sinωt for the pitch channel and 1.5° $\epsilon_p$ sinωt for the yaw channel.

It is next necessary to measure the values of $|\epsilon_y|$ and $|\epsilon_p|$, which is accomplished by correlating the original sinusoidal signal from the 2 Hz oscillator 78 with each of the error rate signals in correlators 71 and 72.

The output of each correlator is filtered and drives respective sample and hold circuits 75 and 76. After time for LP filters 73 and 74 to integrate the output of correlators 71 and 72, sample and hold circuits 75 and 76 are set in the HOLD mode which causes the hold circuit to store the respective dc error magnitude voltages, $|\epsilon_{p(E)}|$ or $|\epsilon_{y(E)}|$. These error magnitudes are applied to scale factor memory 82 and scale factor memory 84 which each also receive a signal from the roll rate sensing circuit 54 which is equal to 1.5° sin$\omega_t$.

Figure 8:
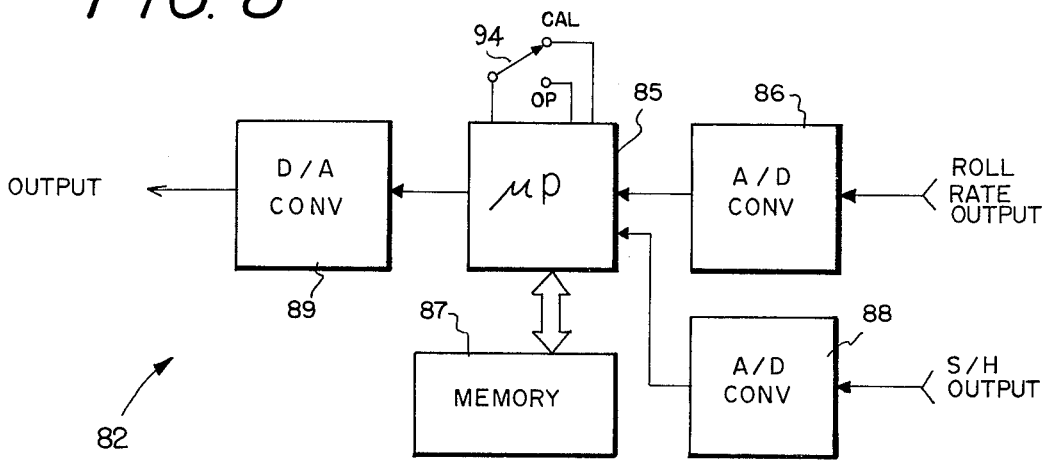
FIG. 8 is a block diagram of a typical scale factor memory required in the system of FIG. 7.

Referring to FIG. 8, a block diagram of the pitch scale factor memory 82 is shown which utilizes a microprocessor 85 having a non-volatile memory 87. The sample and hold circuit 76 output drives analog-to digital (A/D) converter 88 while the roll rate output signal drives A/D converter 86. Microprocessor 85 is programmed to calculate the ratio of the peak value of the roll rate output signal to the value of the sample/hold output. When switch 94 in the scale factor memory circuit 82 is set to the cdlibrate position, the calculated ratio, or scaling factor, will be stored in non-volatile memory circuit 87 as the pitch misalignment error correction factor.

It is to be understood that yaw scale factor memory 84 of FIG. 7 utilizes the identical circuit as that of FIG. 8. After calibration, switches 94, 98, 99, 91, 92 and the CAL-OP switches for memories 82 and 84 are set to their OPERATE positions and the system is properly calibrated.

In normal operation of the TADS in accordance with the invention, a movement of the aircraft may be such as to create a roll rate signal output from sensing circuit 54 of FIG. 6. In such case, the microprocessor 85 is programmed so that any roll rate sensing circuit output will have its amplitude controlled by the pitch scale factor stored in memory 82 and the yaw scale factor stored in memory 84 (blocks 40, 50 in FIG. 6), and the scaled roll rate signals applied to input summers 41 and 42 of the pitch rate servo 52 and the yaw rate servo 53. Therefore, these signals will add to the command rate signals, produced due to the motion of the platform, with the proper phase or polarity to cancel the misalignment errors in each channel. Thus, the scale factor memory circuits 82, 84 compensate electronically for the mechanical misalignment of the optical axis of the TADS.

Figure 9:
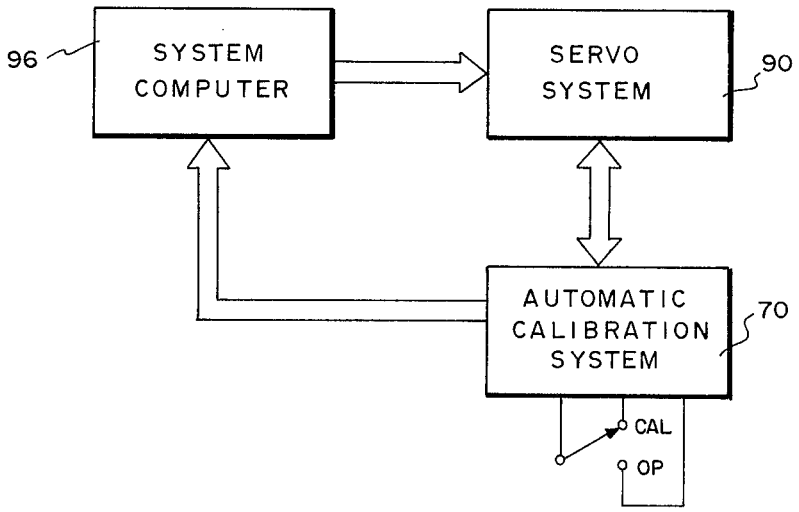
FIG. 9 is a simplified block diagram of an alternative embodiment of the automatic calibration system utilizing the system computer.

An alternative embodiment of the automatic calibration system is illustrated in simplified block diagram form in FIG. 9. Here, the servo system utilized in the TADS stabilized platform is indicated as block 90 and the TADS system computer as block 96. The automatic calibration system 70 receives rate error inputs from servo system 90 and is connected directly to TADS system computer 96 which is programmed to perform the functions described above and to store the measured scale factors for use when the system is in operation as will be obvious to those of skill in the art. In FIG. 9, the automatic calibration system 70 includes the 2 Hz oscillator 78, and an interface to system computer 96 to permit selecting the calibrate or operate mode. The functions of the measuring circuits such as oscillator 78, correlator 72, low pass filter 74, and sample/hold circuit 76, and scale factor storage circuits such as scale factor memory 82 and scale factor memory 84 are provided in this alternative embodiment by programmed functions of computer 96 thereby reducing the weight and complexity of the hardware implementation described hereinabove.

Although the present invention has been described and explained with reference to the TADS, it will be apparent that it is equally applicable to any type of stabilized platform system in which exact mechanical alignment between an optical axis and the stabilization axis is difficult and costly. While the steps in the method and the particular apparatus have been disclosed with specificity, equivalent circuits and steps are to be considered within the spirit and scope of the invention.

APPENDIX

This appendix will develop the mathematical relationships utilized in the invention utilizing the TADS for explanatory purposes.

Each gyro has a sensitive axis (IA or input axis) which the servo will maintain in a fixed direction in inertial space if the servo is in the stabilized mode. The two input axes for pitch and yaw define a plane. An axis defined as the stabilization axis is perpendicular to this plane. The stabilization axis is the axis which stays fixed in space as the TADS mounting structure, i.e., aircraft, is moved. If this axis is not aligned with the optical axis of the TADS optics, the picture will not appear to be stabilized if the TADS rolls.

A simple calculation will give the amount of motion of the image due to gyro misalignment. Let $\epsilon_p$=gyro misalignment (mrad)

$\epsilon_y$=yaw gyro misalignment (mrad)

Then the radius of the circle which the target makes as TADS rolls is $$\epsilon_{TOTAL}=\sqrt{\epsilon_p^2+\epsilon_y^2} \tag{1}$$

Further, the vertical and horizontal components of the motion are $$\begin{bmatrix} 0 \\ \epsilon_v \\ \epsilon_H \end{bmatrix}_{INERTIAL} = T_{-\phi} \begin{bmatrix} 0 \\ \epsilon_p \\ \epsilon_y \end{bmatrix}_{TADS} \tag{2}$$

where $\phi$ is the roll angle of the TADS.

Differentiating this equation gives:

$$\begin{bmatrix} 0 \\ \dot{\epsilon}_v \\ \dot{\epsilon}_H \end{bmatrix}_{INERTIAL} = \frac{d}{dt} T_{-\phi} \begin{bmatrix} 0 \\ \epsilon_p \\ \epsilon_y \end{bmatrix}_{TADS} \tag{3}$$

Resolving $\dot{\epsilon}_v$ and $\dot{\epsilon}_H$ back into the TADS coordinate system gives:

$$\begin{bmatrix} 0 \\ \dot{\epsilon}_p \\ \dot{\epsilon}_y \end{bmatrix}_{TADS} = T_\phi \begin{bmatrix} 0 \\ \dot{\epsilon}_v \\ \dot{\epsilon}_H \end{bmatrix}_{INERTIAL} \tag{4}$$

$$= T_\phi \frac{d}{dt} T_{-\phi} \begin{bmatrix} 0 \\ \epsilon_p \\ \epsilon_y \end{bmatrix}_{TADS} \tag{5}$$

Now, $$\frac{d}{dt} T_{-\phi} = \frac{d}{dt} \begin{bmatrix} 1 & 0 & 0 \\ 0 & \cos\phi & -\sin\phi \\ 0 & \sin\phi & \cos\phi \end{bmatrix} \tag{6}$$

$$= \begin{bmatrix} 0 & 0 & 0 \\ 0 & -\sin\phi & -\cos\phi \\ 0 & \cos\phi & \sin\phi \end{bmatrix} \dot{\phi}$$

And $$T \frac{d}{dt} T_{-\phi} = \begin{bmatrix} 1 & 0 & 0 \\ 0 & \cos\phi & \sin\phi \\ 0 & -\sin\phi & \cos\phi \end{bmatrix} \begin{bmatrix} 0 & 0 & 0 \\ 0 & -\sin\phi & -\cos\phi \\ 0 & \cos\phi & -\sin\phi \end{bmatrix} \dot{\phi} \tag{7}$$

$$= \begin{bmatrix} 0 & 0 & 0 \\ 0 & 0 & 1 \\ 0 & -1 & 0 \end{bmatrix} \dot{\phi}$$

$\dot{\epsilon}_p$ and $\dot{\epsilon}_y$ are then given by:

$$\begin{bmatrix} 0 \\ \dot{\epsilon}_p \\ \dot{\epsilon}_y \end{bmatrix} = \begin{bmatrix} 0 & 0 & 0 \\ 0 & 0 & 1 \\ 0 & -1 & 0 \end{bmatrix} \begin{bmatrix} 0 \\ \epsilon_p \\ \epsilon_y \end{bmatrix} \dot{\phi} \tag{8}$$

In order to calculate $\epsilon_p$ and $\epsilon_y$, the following steps are assumed:

1. The TADS is pitched down approximately 45 degrees.
2. A convenient fixed target is acquired. The tracker loop gain is reduced so that the tracker only eliminates the long term drift errors.
3. Using the TADS computer, the AZ gimbal is oscillated at a low frequency $\omega$, say 2 Hz. The tracker will then give two outputs, $\dot{\epsilon}_p$ and $\dot{\epsilon}_y$. These two outputs can be used to calculate $\dot{\epsilon}_p$ and $\epsilon_y$ in a closed loop fashion.

The component of roll due to the azimuth oscillation is given by:

$$\begin{bmatrix} \dot{\phi} \\ \dot{\theta} \\ \dot{\chi} \end{bmatrix} = T\theta_{EL} \begin{bmatrix} 0 \\ 0 \\ \sin\omega t \end{bmatrix} \tag{9}$$

$$= \begin{bmatrix} \cos\theta & 0 & -\sin\theta \\ 0 & 1 & 0 \\ \sin\theta & 0 & \cos\theta \end{bmatrix} \begin{bmatrix} 0 \\ 0 \\ \sin\omega t \end{bmatrix}$$

$$\dot{\phi} = -\sin\theta_{EL} \sin\omega t. \tag{10}$$

Putting this value for $\phi$ into equation 1 gives:

$$\begin{bmatrix} 0 \\ \dot{\epsilon}_p \\ \dot{\epsilon}_y \end{bmatrix} = -\begin{bmatrix} 0 & 0 & 0 \\ 0 & 0 & 1 \\ 0 & -1 & 0 \end{bmatrix} \begin{bmatrix} 0 \\ p \\ y \end{bmatrix} \sin\theta_{EL} \sin\omega t \tag{11}$$

Multiplying out gives:

$\epsilon_p = -\epsilon_y \sin \phi_{EL} \sin\omega t$ $\epsilon_y = +\epsilon_p \sin \phi_{EL} \sin\omega t.$ A trig identity and a theorem from calculus are now needed. First, the identity is:

$$\sin^2\omega t = \tfrac{1}{2}(1 - \cos 2\omega t) \tag{12}$$

and second, the therorem is:

$$\int_{-\pi}^{\pi} \sin mt \sin nt dt = \begin{cases} \pi, & n = m \\ 0, & n = m \end{cases} \tag{13}$$

The theorem can be extended to $$\lim_{N\to\infty} \frac{1}{N} \int_0^{2N\pi} \sin\omega_1 t \sin\omega_2 t \, dt = \begin{cases} \pi, & \omega_1 = \omega_2 \\ 0, & \omega_1 \neq \omega_2 \end{cases} \tag{14}$$

Multiplying the equations for $\epsilon_p$ and $\epsilon_y$ by $\sin\omega t$ gives:

$$\begin{aligned} \dot{\epsilon}_p \sin\omega t &= -\epsilon_y \sin\theta_{EL} \sin^2\omega t \\ &= -\epsilon_y \sin\theta_{EL} (\tfrac{1}{2} - \tfrac{1}{2} \cos 2\omega t) \end{aligned} \tag{15}$$

$$\begin{aligned} \dot{\epsilon}_y \sin t &= +\epsilon_p \sin\theta_{EL} \sin^2\omega t \\ &= +\epsilon_p \sin\theta_{EL} (\tfrac{1}{2} - \tfrac{1}{2} \cos 2\omega t) \end{aligned} \tag{16}$$

Low pass filtering the above equations results in:

$$\dot{\epsilon}_p \sin\omega t_{LPF} = -\tfrac{1}{2}\epsilon_y \sin\theta_{EL} \tag{17}$$

$$\dot{\epsilon}_y \sin\omega t_{LPF} = +\tfrac{1}{2}\epsilon_p \sin\theta_{EL} \tag{18}$$

or rewriting, solving for $\epsilon_y$ and $\epsilon_p$ $$\epsilon_y = \frac{2}{-\sin\theta_{EL}} \dot{\epsilon}_p \sin\omega t_{LPF} \tag{19}$$

$$\epsilon_p = \frac{2}{+\sin\theta_{EL}} \dot{\epsilon}_y \sin\omega t_{LPF} \tag{20}$$

Applying the theorem of equation 14, all components of the $\dot{\epsilon}_p$ and $\dot{\epsilon}_y$ signals will be rejected except the component at $\omega$.

I claim:

1. In an airborne optical target acquisition and tracking system having an optical subsystem disposed on a stabilized platform, said platform controlled by an elevation drive, an azimuth drive, a roll rate sensing circuit, a pitch rate servo, and a yaw rate servo, apparatus for calibrating and compensating the system for misalignment between the stabilization axis of said platform and the axis of said optical subsystem comprising:

(a) scaling means connected to said roll rate sensing circuit to receive roll rate signals therefrom, and having pitch error signal output connected to said yaw rate servo, and yaw error signal output connected to said pitch rate servo, said scaling means for producing an error singal at said pitch error signal output proportional to the yaw component of said misalignment, and an error signal at said yaw error signal output proportional to the pitch component of said misalignment; and (b) calibration means including (i) low frequency oscillator means connected to said azimuth drive for moving said platform in yaw, thereby producing a roll rate proportional to said misalignment and a roll rate signal from said roll rate sensing circuit for calibration of said system, (ii) first adjustment means connected to said scaling means for adjusting said pitch error signal output due to said low frequency oscillator to compensate for an azimuthal component of said misalignment, and (iii) second adjustment means connected to said scaling means for adjusting said yaw error signal output due to said low frequency oscillator to compensate for an elevational component of said misalignment.

2. The apparatus as defined in claim 1 in which said first adjustment means comprises a pitch voltage divider having its input connected to said roll rate sensing circuit and having a first adjustable output, said second adjustment means comprises a yaw voltage divider having its input connected to said roll rate sensing circuit and having a second adjustable output, and said scaling means includes a yaw amplifier having its input connected to said second adjustable output and an output connected to the input of said yaw rate servo, and a pitch amplifier having its input connected to said first adjustable output and an output connected to the input of said pitch rate servo.

3. The apparatus defined in claim 2 in which said first and second adjustment means include pitch tracking and yaw tracking target acquisition display means for indicating when said first and second adjustment means are correctly adjusted.

4. The apparatus as defined in claim 1 in which said scaling means comprises:

pitch scale factor memory means having an input connected to said roll rate sensing circuit, a dc pitch error signal input, an output connected to said yaw rate servo, and a first switch having a calibrate and an operate position;

yaw scale factor memory means having an input connected to said roll rate sensing circuit, a dc yaw error signal input, an output connected to said pitch rate servo, and a second switch having a calibrate and an operate position;

a pitch rate servo tracker output for producing a pitch error output signal responsive to said low frequency oscillator means, said pitch error output signal being proportional to the yaw component of said misalignment;

a yaw rate servo tracking output for producing a yaw rate error output signal responsive to said low frequency oscillator means, said yaw error output signal being proportional to the pitch component of said misalignment;

a pitch rate error output signal magnitude measuring means connected to said yaw rate servo tracking error output via a third switch having a calibrate and an operate position, for producing a dc pitch error signal, said dc pitch error signal being communicated to said dc pitch error signal input of said yaw scale factor memory means;

a yaw rate error output signal magnitude measuring means connected to said pitch rate servo tracking error output via a fourth switch having a calibrate and an operate position, for producing a dc yaw error signal, said dc yaw error signal being communicated to said dc yaw error signal input of said pitch scale factor memory means;

said yaw scale factor memory means including first calculating means for calculating a first ratio of the peak value of signals from said roll rate sensing circuit to said dc yaw error signal and first non-volatile memory for storing said first ratio; and said pitch scale factor memory means including second calculating means for calculating a second ratio of the peak value of signals from said roll rate sensing circuit to said dc pitch error signal and second non-volatile memory for storing said second ratio.

5. The apparatus as defined in claim 4 in which each of said pitch and yaw rate error magnitude measuring means respectively comprises:

a correlator having an input from said low frequency oscillator and from a respective pitch or yaw tracking error output;

a low pass filter connected to receive the output of said correlator, thereby producing at its output a slowly varying error signal; and a sample and hold circuit connected to receive said varying error signal for producing a peak dc error signal.

6. The apparatus as defined in claim 5 in which said pitch and yaw scale factor memories each comprise:

a first analog-to-digital converter connected to the output of said roll rate sensing circuit;

a second analog-to-digital converter connected to the output of said sample and hold circuit;

microprocessor means having a calibrate/operate switch connected thereto and a non-volatile memory associated therewith, said microprocessor means connected to the outputs of said first and second analog-to-digital converters;

said microprocessor means, when said switch is in its calibrate position, for calculating digitally the magnitude of a roll rate signal received from said first analog-to-digital converter and calculating its ratio to the amplitude of the sample and hold circuit output from said second analog-to-digital converter, said microprocessor means storing said ratio in said non-volatile memory means whereby such value remains stored in said memory means when said switch is switched to its operate position, said microprocessor means thereafter changing the amplitude of incoming roll rate signals by said stored ratio; and digital-to-analog converter means connected to receive such scaled roll rate signals from said microprocessor means for adding to respective pitch and yaw rate commands to said servos when said switch is in its operate position.

7. An airborne optical target acquisition and tracking system having an optical system disposed on a platform stabilized in pitch and yaw in which the stabilization axis is slightly misaligned with respect to the optical system axis comprising:

a pitch rate servo system for controlling said platform in pitch having a pitch summing input;

a yaw rate servo system for controlling said platform in yaw having a yaw summing input;

a roll rate sensing circuit for producing a roll rate output signal;

a command computer connected to said summary inputs of said pitch and yaw rate servo systems for controlling the position of said optical system axis with respect to a target;

a first scaling factor circuit connected to receive said roll rate output signal from said roll rate sensing circuit for producing a yaw compensating signal at said yaw summing input proportional to the effect of said misalignment on said platform in pitch; and a second scaling factor circuit connected to receive said roll rate output signal from said roll rate sensing circuit for producing a pitch compensating signal at said pitch summing input proportional to the effect of said misalignment on said platform in yaw.

8. In an airborne optical target acquisition and tracking system having pitch and yaw rate servo subsystems for stabilizing a platform supporting an optical subsystem, and a computer for controlling the pitch and yaw servo subsystems, a method for calibrating the system to compensate for mechanical misalignment between the optical axis of the optical system and the stabilization axis of the platform comprising the steps of:

acquiring and tracking a fixed optical target with the system;

producing a rolling motion of the system so as to produce an apparent motion of the target with respect to the stabilization axis;

producing a roll rate signal from such rolling motion;

modifying the amplitude of the roll rate signal by a first adjustable gain amplifier;

summing the first modified amplitude roll rate signal with pitch computer commands to the pitch rate servo subsystem;

modifying the amplitude of the roll rate signal by a second adjustable gain amplifier;

summing the second modified amplitude roll rate signal with computer command signals to the yaw rate servo subsystem; and adjusting the first and second adjustable gain amplifiers until the apparent motion of the target with respect to the stabilization axis is reduced essentially to zero.

9. The method defined in claim 8 in which the adjusting step includes the steps of:

observing apparent target motion on a system display; and performing the adjustment until the target remains at the center of the display.

10. The method defined in claim 8 in which the adjusting step includes the steps of:

measuring the target tracking voltages in the system; and performing the adjustment until the target tracking voltages are essentially zero.

11. In an airborne optical target acquisition and tracking system having a four gimballed, gyro stabilized platform for supporting an optical subsystem, a roll rate sensing circuit, a pitch rate servo, a yaw rate servo, a non-volatile pitch memory connected to the roll rate sensing circuit output, a non-volatile yaw memory connected to the roll rate sensing circuit output, and a computer for controlling the platform for tracking of targets, a method for calibrating and compensating the system for misalignment between the stabilization axis of the platform and the axis of the optical subsystem comprising the steps of:

A. disposing a fixed optical target at an acute angle in pitch from the horizontal;

B. acquiring the fixed optical target;

C. applying a low frequency sinusoidal signal to the yaw rate servo to thereby produce (a) a rolling motion of the platform proportional to the mechanical misalignment between the stabilization axis and the optical axis, (b) a pitch tracking error signal from the computer, (c) a yaw tracking error signal from the computer, and (d) a roll rate signal from the roll rate sensing circuit;

D. correlating the low frequency sinusoidal signal with the pitch tracking error signal;

E. correlating the low frequency sinusoidal signal with the yaw tracking error signal;

F. producing a pitch tracking error dc signal amplitude from the pitch correlation step;

G. producing a yaw tracking error dc signal amplitude from the yaw correlation step;

H. calculating the ratio between the amplitude of the roll rate signal and the pitch tracking error dc amplitude signal;

I. storing the pitch tracking error ratio in a non-volatile memory;

J. calculating the ratio between the amplitude of the roll rate signal and the yaw tracking error dc amplitude signal;

K. storing the yaw tracking error ratio in a non-volatile memory;

L. disconnecting the sinusoidal signal from the yaw rate servo;

M. producing a yaw rate compensation signal by scaling an output from the roll rate sensing circuit with the stored yaw tracking error ratio, and summing the yaw rate compensation signal with the input to the pitch rate servo; and N. producing a pitch rate compensation signal by scaling an output from the roll rate sensing circuit with the stored pitch tracking error ratio, andsumming the pitch rate compensation signal with the input to the yaw rate servo.

12. The method as defined in claim 11 which further comprises the steps of:

O. placing the system in an operate mode;

P. scaling the roll rate signal when present by the stored pitch tracking error ratio to produce the first scaled roll rate signal;

Q. summing the first scaled roll rate signal with computer command signals to the yaw rate servo;

R. scaling the roll rate signal when present by the stored yaw tracking error ratio to produce the second scaled roll rate signal; and S. summing the second scaled roll rate signal with computer command signals to the pitch rate servo.

* * * * *